US008375649B2

(12) United States Patent
Grotz et al.

(10) Patent No.: US 8,375,649 B2
(45) Date of Patent: Feb. 19, 2013

(54) SUPPORT ARM FOR A LIFTING PLATFORM

(75) Inventors: Juergen Grotz, Wiggensbach (DE); Winfried Schmitt, Bichl (DE); Thomas Deuring, Hopferbach (DE)

(73) Assignee: Maha Maschinenbau Haldenwang GmbH & Co. KG, Haldenwang (DE)

( * ) Notice: Subject to any disclaimer, the term of this patent is extended or adjusted under 35 U.S.C. 154(b) by 771 days.

(21) Appl. No.: 12/226,775

(22) PCT Filed: Jan. 29, 2007

(86) PCT No.: PCT/DE2007/000155

§ 371 (c)(1),
(2), (4) Date: Oct. 28, 2008

(87) PCT Pub. No.: WO2007/128251

PCT Pub. Date: Nov. 15, 2007

(65) Prior Publication Data

US 2009/0188758 A1 Jul. 30, 2009

(30) Foreign Application Priority Data

May 4, 2006 (DE) ..... 20 2006 007 156 U

(51) Int. Cl.
*B66F 7/28* (2006.01)

(52) U.S. Cl. ..... 52/118; 52/632; 52/843; 212/348

(58) Field of Classification Search ..... 52/118, 52/632, 843; 212/348
See application file for complete search history.

(56) References Cited

U.S. PATENT DOCUMENTS

| | | | | | |
|---|---|---|---|---|---|
| 1,974,458 | A | * | 9/1934 | Hallquist | 52/843 |
| 2,415,236 | A | * | 2/1947 | De Vigier | 52/632 |
| 2,772,790 | A | * | 12/1956 | Kauffman | 212/348 |
| 4,134,236 | A | * | 1/1979 | Ott | 52/632 |
| 4,600,348 | A | * | 7/1986 | Pettit | 52/632 |

FOREIGN PATENT DOCUMENTS

| | | | |
|---|---|---|---|
| DE | 22 22 035 | A1 | 11/1973 |
| EP | 1 156 009 | A1 | 11/2001 |
| EP | 1 354 843 | A2 | 10/2003 |
| FR | 2 302 272 | A1 | 9/1976 |

* cited by examiner

*Primary Examiner* — Mark Wendell
*Assistant Examiner* — Matthew J Smith
(74) *Attorney, Agent, or Firm* — Oliff & Berridge, PLC

(57) ABSTRACT

The subject matter of the invention relates to a support arm for a lifting platform, comprising at least one relatively wide support arm and an extension arm telescopically slidable therein, the arms each having torsionally rigid and flexurally stiff hollow profiles, a support bearing at the rear end of the accommodating arm for the pivotable hinging connection to a lifting carriage of a column and a bearing foot at the free end of the respective extension arm. A cost-effective production of support arms in different sizes and shapes is obtained by cutting at least the accommodating arm from a steel panel blank and forming it into a hollow profile and providing it with at least one transverse reinforcement.

8 Claims, 4 Drawing Sheets

SUPPORT ARM FOR A LIFTING PLATFORM

The invention relates to a support arm for a lifting platform, in particular a column lifting platform, having at least one relatively wide accommodating arm and an extension arm which is telescopically movable therein, the arms each consisting of torsionally rigid and flexurally stiff hollow profiles, wherein the rear end of the accommodating arm is provided with a support bearing via which the support arm is hinged to a lifting carriage of a column in horizontally pivotable fashion and wherein a bearing foot, on which different supporting elements can be arranged and mounted, is attached to the free end of the inner extension arm.

Such support arms are known in particular in combination with so-called column lifting platforms for motor vehicles. Two support arms each are hinged to the lifting carriage of a column via sufficiently rigid bearing arrangements so that each support arm can separately be pivoted in the horizontal plane. In order to be able to position the suitable support elements in the respectively prescribed positions underneath the vehicle bottom, it is necessary for the respective support arms to be not only pivotable but also adjustable as regards length, which is achieved by a telescopic design of each support arm. Correspondingly, a support arm consists of an inner accommodating arm and an extension arm coaxial therewith, which is accommodated in longitudinally movable fashion in the accommodating arm hinged to the lifting carriage on the rear side. Since the freely protruding telescopic arms introduce the load of a motor vehicle to be lifted via the support bearing into the lifting carriage and thus into the column, the support arms must have sufficiently high torsional rigidity and flexural stiffness to ensure a safe mount and support of the supported motor vehicle in the fully extended state as well. In order to obtain sufficient rigidity, the previously used support arms made of extruded hollow profiles in full jacket design usually consist of relatively high-grade steels. The extruded hollow profiles were purchased as starting material from press plants and further processed into the support arms of different sizes.

In addition to the relatively high cost of the extruded profile material, it is a drawback that the manufacturers of lifting platforms and thus also of the support arms thereof are bound to the sizes and types of the profile material so that the support arms cannot be adapted to the special requirements of a particular lifting platform.

It is the object of this invention to develop a support arm for a lifting platform, which can be produced in cost-effective manner and in almost any sizes and shapes with relatively little effort.

According to the invention this object is achieved in that at least the accommodating arm is shaped from a steel panel blank into the hollow profile and has at least one transverse reinforcement.

The support arms according to the invention can be produced in a way substantially cheaper than that of the support arms consisting of extruded profiles. In addition, the support arms according to the invention can be produced by relatively simple forming processes in the most different types and profile cross-sections, which was not possible with conventional support arms on account of the binding to given cross-sections of the respectively used extruded profile. In order to produce the support arms according to the invention, hot-rolled or cold-rolled steel plates of respectively appropriate wall thickness ranging from 5.0 to 12.0 mm are used as starting material. Blanks of suitable shape are cut from these steel plates, preferably by laser cutting. These planar plate blanks are cold-formed into round or edge hollow profiles on technically simple and effective bending machines. In this connection, the cross-sections of the respective accommodating arms and the attributed extension arms are chosen such that the respective extension arm is axially slidable and can be moved into the accommodating arm with relatively small transverse clearance.

Even though the two arm parts of each support arm, i.e. the accommodating arm and the extension arm, may also have circular or differently rounded cross-sections, it is more useful for at least the wider accommodating arm to have a square hollow profile and preferably have a continuous longitudinal slot of given width on its bottom side. A torsion-preventing longitudinal guide of the extension arm is achieved in the wider accommodating arm by the square hollow profile.

In order to provide the support arms with the strength necessary for the lifting operation, every longitudinally slotted hollow profile of a wider accommodating arm and also of an extension arm movable therein is provided with at least one transverse reinforcement which may be designed in different ways. When the longitudinal slots of the respective arm only have a relatively narrow width, point-shaped or seam-shaped welded joints of the edges may be useful. The positive connection of both bent longitudinal edges defining the longitudinal slot leads to a high torsional rigidity and flexural stiffness of the respective support arm part, which can be compared with that of a conventional extruded hollow profile. Transverse reinforcements which are formed as brackets and preferably cover the longitudinal slot in the free end portion of the respective accommodating arm and are permanently attached to the outside of the hollow profile, e.g. by welding, offer advantages regarding the manufacturing technology and function.

In order to obtain an easily pivotable high-strength hinging connection of the support arm according to the invention to the lifting carriage of a column, the support bearing provided at the inner end of the accommodating arm consists of several structurally simple individual parts which can be produced in cost-effective manner by simple cutting and bending processes and are firmly interconnected, in particular joined by welding, to give a stable support bearing design. The accommodating arm of the end-side support bearing suitably has a transverse plate permanently attached to the end edges of the hollow profile and two bearing plates arranged at the arm end at a lateral distance whose mutually aligning bores are engaged by a pivot formed on the lifting carriage. A bent, longitudinally oriented bearing plate which is joined with the transverse plate by welding, for example, or is firmly connected thereto in any other way and has the bearing bore in its protruding end portion, is suitably mounted on the top side of the accommodating arm.

The extension arm is also suitably designed as a square hollow profile having a bottom-side longitudinal slot and its inner telescoping end carries a transverse plate which has a small clearance with respect to the bottom side of the accommodating arm. A support plate is attached to the outer end of the extension arm by two transverse plates using respective welded joints.

In order to obtain sufficient extension lengths, the support arms can also have multiple telescopic designs, i.e. in addition to the inner accommodating arm and the outer extension arm they may have a central arm portion which, on the one hand, is movably guided in the accommodating part and, on the other hand, is used for the longitudinally movable accommodation of the extension arm. This central arm portion also consists of an edge profile produced by the bending deformation of a planar plate blank with continuous longitudinal slot and transverse reinforcement.

Embodiments of the invention are described below in detail with reference to the drawing wherein FIG. 1 shows a perspective view of the column of a motor vehicle column lifting platform by way of a schematic illustration;

FIG. 2 shows an enlarged perspective view of section A in FIG. 1;

FIGS. 3*a* to *e* show several illustrations of an embodiment of the support arm according to the invention;

FIGS. 4*a* to 4*e* show several illustrations of another embodiment of a support arm according to the invention.

Figure 1:
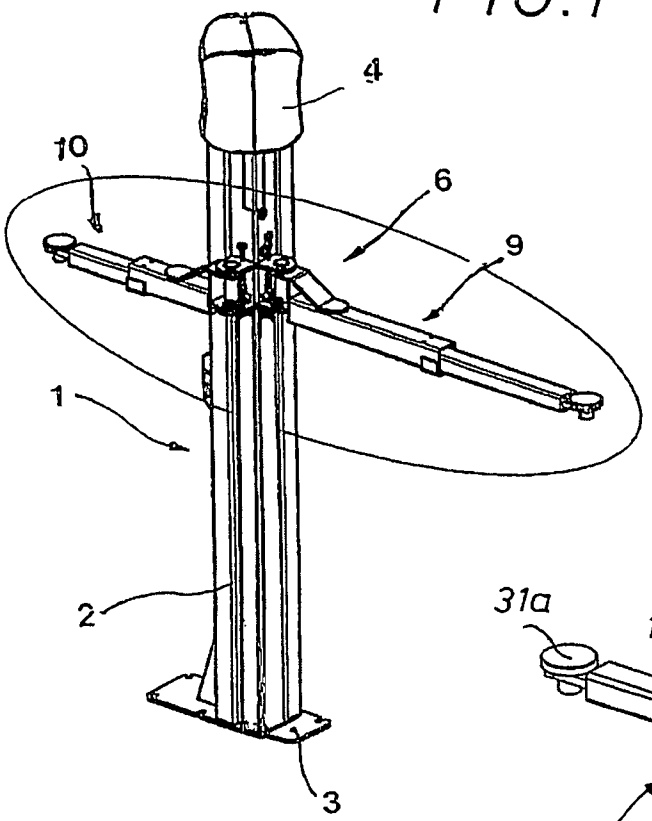

Column 1 shown in FIG. 1 belongs to a two column lifting platform for motor vehicles but can also be part of a so-called four column lifting platform. A bottom plate 3, which is firmly fixed in the foundation by studs, for example, is mounted on the dimensionally stable and loadable column body 2 formed as a flat steel structure or as an extruded light metal profile. A threaded spindle is disposed within the casing of column 1. This spindle runs in lower and upper pivot bearings and carries a nut connected with a unit referred to as lifting carriage 5. The upper end of the threaded spindle is connected with the driven shaft of an electric motor 4 which drives the threaded spindle so that the nut supported thereon performs lifting and lowering movements.

A support bearing arrangement 6 is mounted on the lifting carriage 5 adapted to be lifted and lowered. It has a support bearing 7, 8 for each horizontal support arm 9, 10. Both support arms 9, 10 are of equal design so that only one of the two support arms 9, 10 used for each column 1 will be described below.

FIG. 3 shows an embodiment of a support arm 9 in a perspective view (a), in an axial longitudinal section (b), in a plan view (c), in a side view (d) and in an enlarged section (Z in b).

Figure 2:
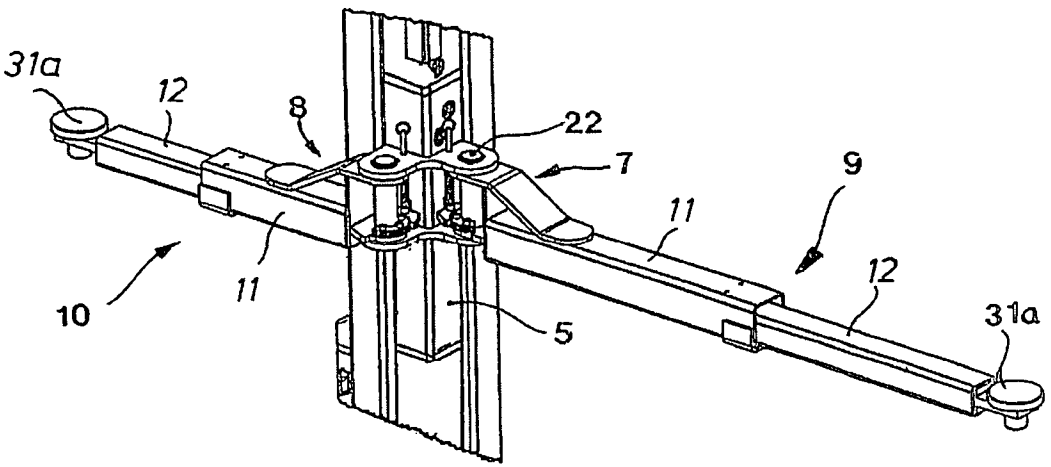

The support arm 9 as shown is shorter than the support arms 8, 9 in FIG. 2 but structurally similar to said support arm designs. The support arm 9 has as main components an accommodating arm 11 and an extension arm 12, both consisting of a square steel profile and having a continuous longitudinal slot on their bottom sides as evident from FIG. 3*e*. Both arms 11, 12 are made of cold-rolled or hot-rolled flat material, preferably a steel plate, which has a thickness of <5 mm to >12 mm.

Figure 3A:
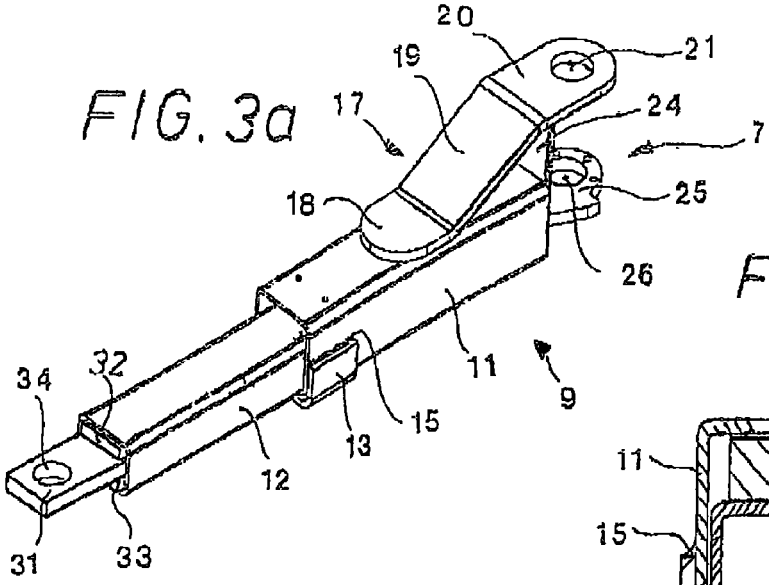
Figure 3E:
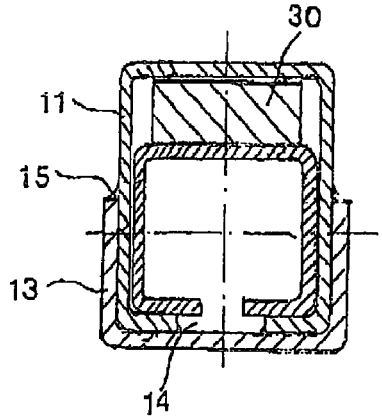
Figure 3B:
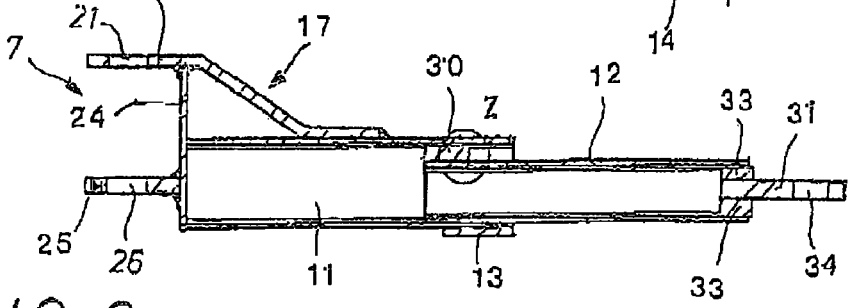
Figure 3C:
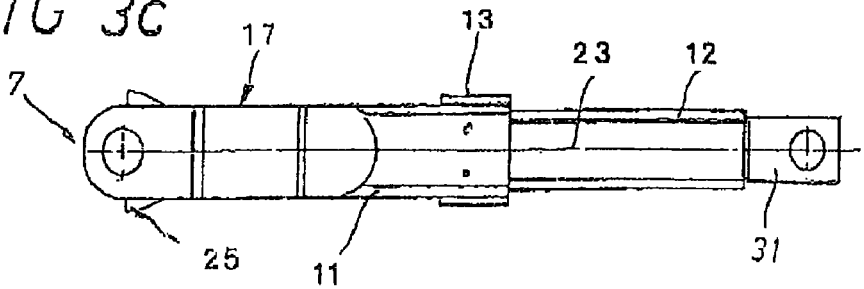
Figure 3D:
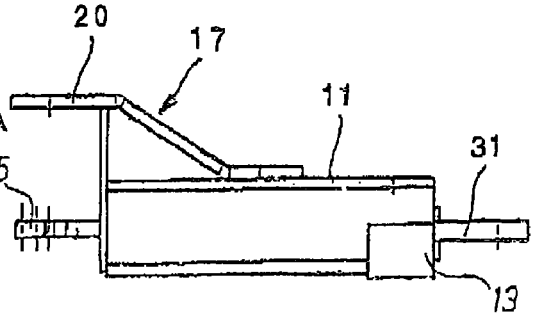
Figures 4A, 4B, 4C, 4D, 4E:
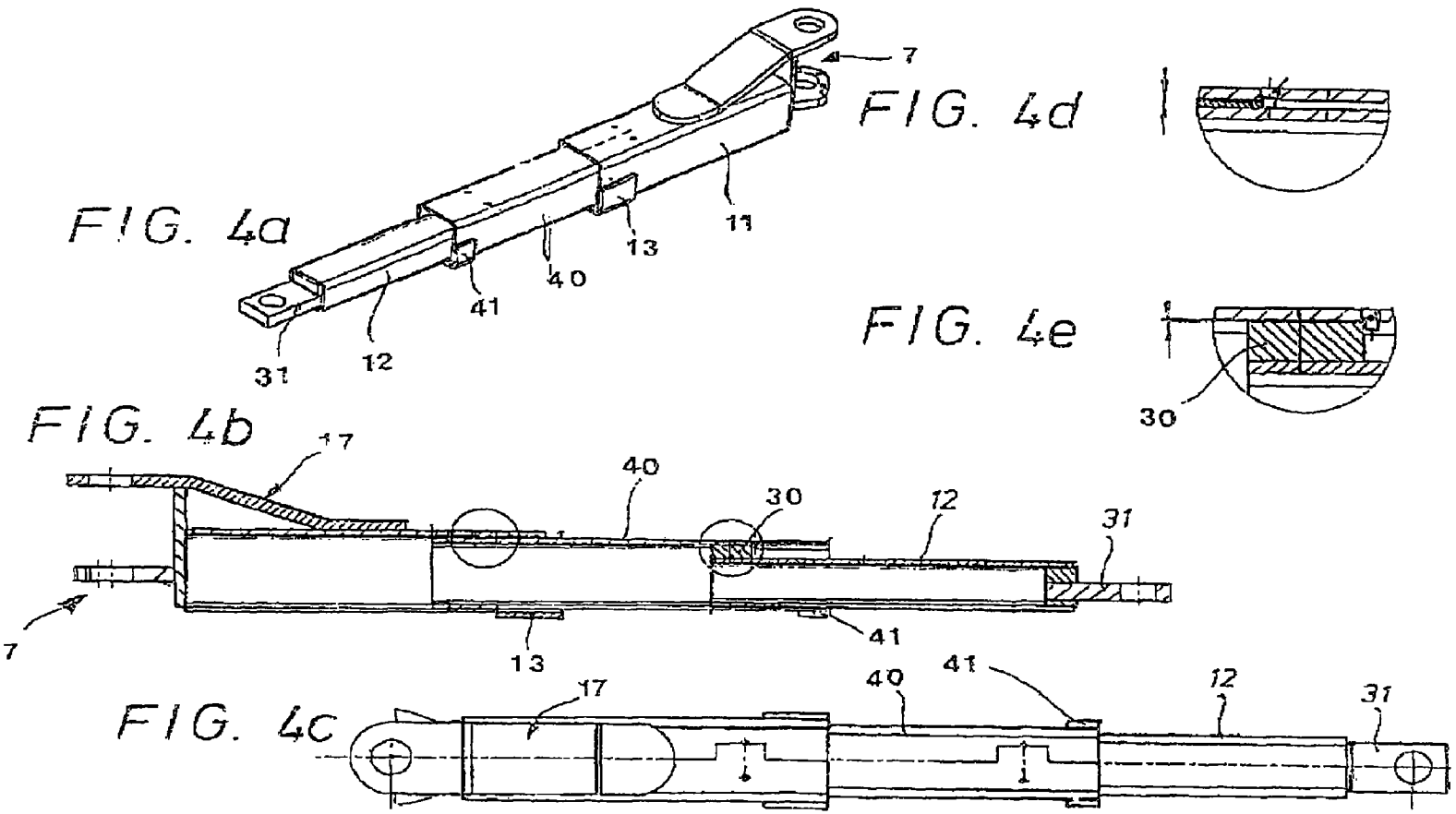

At its front end portion, accommodating arm 11 has a bracket 13 made of steel plate, which—as is evident from FIG. 3*e*—covers the longitudinal slot 14 formed in the bottom side. As shown, the bracket representing a reinforcing element has a C-shaped cross-section and is permanently mounted on the outer wall of the accommodating arm 11, e.g. by welding seams 15.

The support bearing 7 contains an upper double-angled bearing plate 17 which has a width the same as that of the accommodating arm 11 and is made e.g. by laser cutting from a sufficiently stable steel plate blank. The elongate bearing plate 17 has a double-angled shape and consists of a rear semi-circular portion 18 which is mounted, e.g. welded, on the top side of the accommodating arm 11, of an obliquely ascending central portion 19 and an end portion 20 oriented in parallel to the longitudinal axis 23 of the accommodating arm 11 and containing a bore 21 to receive a bearing journal 22 (FIG. 2). A transverse plate 24 extending perpendicularly to the longitudinal axis 23 of the accommodating arm is permanently mounted, e.g. welded, on the inner end side of the accommodating arm 11. Its upper edge is attached to the bottom side of the end portion 20 extruding in tongue-like fashion of the bearing plate 17. As is particularly evident from FIGS. 3*b* and 3*d*, another plate 25 is permanently attached, e.g. by welding, in the lower third of the transverse plate 24. A bearing bore 26 in alignment with bore 21 is formed in said plate to receive the bearing journal 22 (FIG. 2).

In this embodiment, the extension arm 12 also consists of a square hollow profile, as can be taken from FIG. 3*e*. A block-like flat iron 30 serving as a stop is permanently mounted, e.g. by welding, on the top edge of the rear end of the extension arm 12. The top side of said iron slides with a small clearance along the bottom side of the top wall of the accommodating arm 11, as is evident from FIG. 3*b*. The height of this flat iron 30 is matched with the vertical diameter of the extension arm 12 such that a largely tilt-free sliding fit is obtained in the interior of the accommodating arm 11. A support plate 31 is attached centrally between upper and lower block-like flat irons 33 to the free end of the extension arm 12. A bore 34 is developed in the protruding part of this support plate 31 and serves for accommodating a suitable support member 31*a* (FIG. 2). The two block-like flat irons 32, 33 are permanently connected to the central support plate 31 and also to the walls of the extension arm 12 and form an end-side transverse reinforcement of the extension arm 12, which ensures the adequate flexural rigidity and torsional stiffness thereof.

As regards its technical concept and also its structural design, the embodiment shown in FIGS. 4*a* to 4*e* of the support arm 9 according to the invention largely corresponds to the embodiment according to FIGS. 3*a* to 3*e* so that equal components are also denoted by the same reference numerals. In order to extend the extension length, the support arm shown in FIG. 4 has a telescopically extendable central portion 40 which is produced with the same technology as that of the rear accommodating arm 11 and the front extension arm 12 by laser cutting of a steel plate blank and bending into a square profile or as an extruded light metal hollow profile. A bracket-like transverse reinforcement 41, which is permanently connected with the outer walls of the hollow profile, e.g. by welding, is located on the outside of the front end of this central portion 40.

Figure 5:
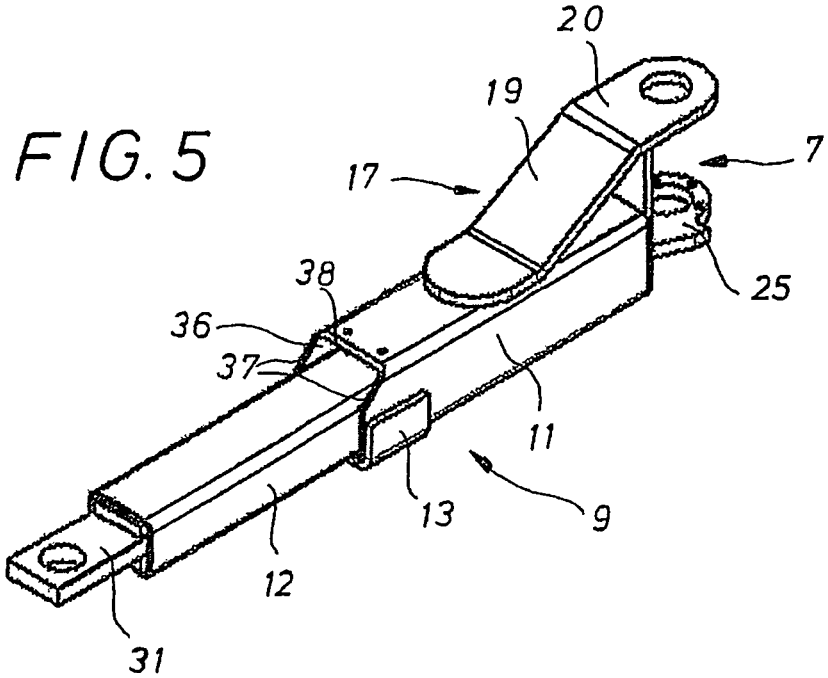
FIG. 5 shows a variant of the support arm illustrated in FIGS. 3*a* to *e*.

FIG. 5 shows a variant of the support arm 9 shown in FIGS. 3*a* to 3*e* as another embodiment of the invention. This support arm 9 shown can be fixed to column 1 according to FIG. 1 or also to another suitable column design of a lifting device. The structural design and also the mode of operation of this variant according to FIG. 5 correspond to those of the support arm 9 shown in FIGS. 3*a* to 3*e*. The design according to FIG. 5 differs from the design according to FIG. 3 in that an aperture 36 is formed in the upper portion of the free end of the accommodating arm 11 and is defined by two inclined end edges 37 of the two side walls and a recessed transverse edge 38 of the upper horizontal cover wall of the accommodating arm 11. Collisions with certain protruding components of the vehicles to be lifted, for example with so-called sills, are avoided by this structural measure.

Figure 6:
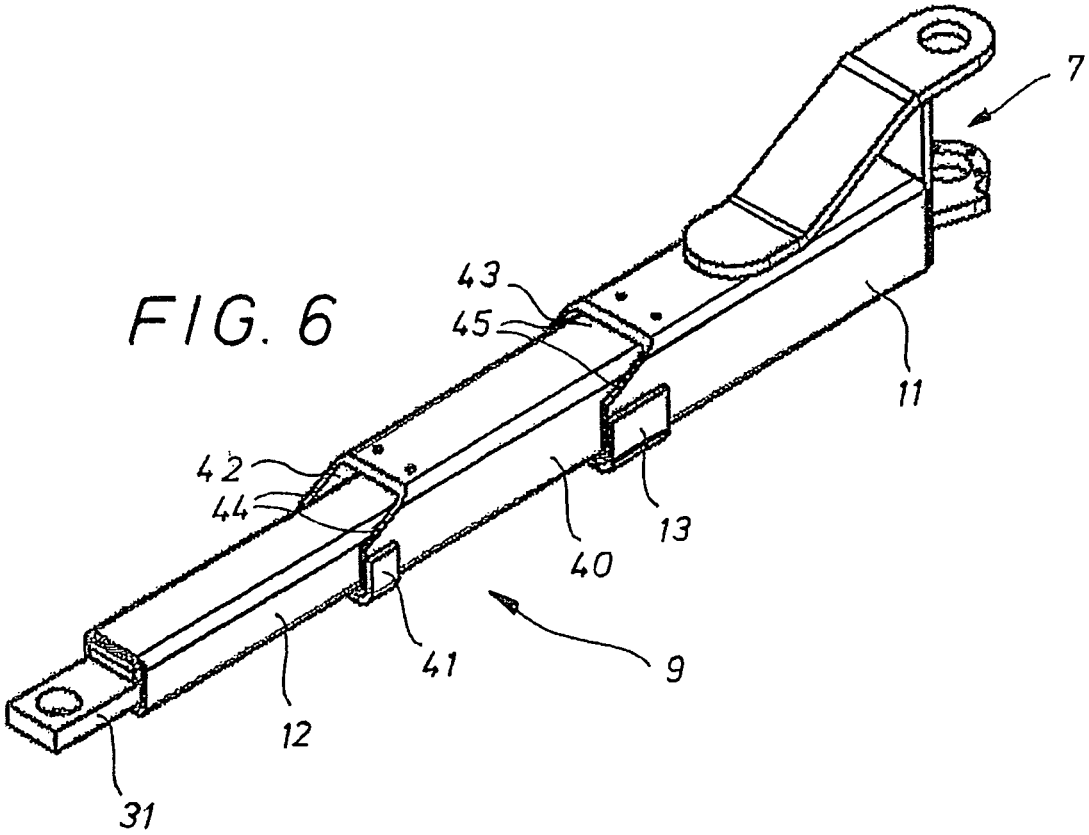
FIG. 6 shows a variant of the support arm illustrated in FIGS. 4*a* to *e*.

The embodiment shown in FIG. 6 of the invention corresponds to the support arm 9 according to FIGS. 4*a* to 4*e* so that equal components are denoted by the corresponding reference numerals. In order to avoid collisions with projecting vehicle parts, this variant according to FIG. 6 has portions 42 and 43 at the free end of the central arm 40 and the accommodating arm 11, respectively, which are each defined by two lateral inclined edges 44, 45 and a recessed upper transverse edge—in the same way as that of the variant according to FIG. 5.

The invention is not limited to the above described embodiments shown in the drawing. For example, instead of the square profiles the accommodating arm and/or also the extension arm may have a different profiled cross-sectional shape. Although the bracket-like transverse reinforcements 13, 41 are particularly advantageous for reasons of manufacturing technology, it is also possible to use other elements, e.g. welding seams, instead of these reinforcing brackets. Alterations are also possible with respect to the support bearings 7 as shown even though this embodiment is cost-effective and offers advantages as regards the manufacturing technology. Individual components should be changed such that the individual components can be made and assembled from simple starting materials in a factory so as to achieve the aspired high flexibility as regards a plurality of different embodiments.

The invention claimed is:

1. A support arm for a lifting platform for motor vehicles, comprising at least one relatively wide accommodating arm and an extension arm telescopically movable therein, the arms each being made of torsionally rigid and flexurally stiff hollow profiles, a support bearing at a rear end of the accommodating arm providing a pivotable hinging connection between a lifting carriage of a column and the accommodating arm, and a bearing foot at a free end of the extension arm, wherein at least the accommodating arm is cut from a steel plate blank and is shaped into the hollow profile, at least one transverse reinforcement mounted on at least the accommodating arm, and configured and arranged to strengthen the accommodating arm, and at least the accommodating arm has a square hollow profile and a continuous longitudinal slot in one wall, wherein the continuous longitudinal slot is formed by a first free end edge in the one wall and a second free end edge in the one wall that face each other at the slot and wherein a support plate is attached between upper and lower block-like flat irons to the free end of the extension arm, the extension arm having a first free end edge and a second free end edge that face each other to form a continuous longitudinal slot that overlaps the continuous longitudinal slot of the accommodating arm, and wherein the free end edges of the extension arm are different dimensions than the free end edges of the accommodating arm, and wherein the block-like flat irons are permanently connected to the support plate and to walls of the extension arm.

2. The support arm according to claim 1, wherein the transverse reinforcement is made as a welding seam or a bracket with a C-shaped cross-section which covers the longitudinal slot and is permanently attached to an outside wall of the accommodating arm.

3. The support arm according to claim 1, wherein the end-side support bearing at the accommodating arm has a transverse plate permanently mounted on end edges of the hollow profile and two bearing plates arranged at the arm end at a transverse distance.

4. The support arm according to claim 3, wherein on a top side of the accommodating arm a bent longitudinally oriented bearing plate is mounted which is firmly connected to the transverse plate and has a bearing bore in its front end portion.

5. The support arm according to claim 1, wherein on the rear end of the extension arm a block-like stop is attached, the top side of which slides with a clearance along the bottom side of the top wall of the accommodating arm.

6. The support arm according to claim 1, wherein the extension arm is formed of a steel panel blank by multiple bending into a square hollow profile longitudinally slotted on one side and has a support plate provided with an accommodating bore for a support disk at its free end.

7. The support arm according to claim 1, wherein between the accommodating arm and the extension arm a telescope arm part is arranged which is guided in longitudinally movable fashion within the accommodating arm where the extension arm can be moved in longitudinally slidable fashion.

8. The support arm according to claim 1, wherein at the free end of the accommodating arm or the telescope arm part an aperture confined on both sides by inclined edges is formed in the top portion thereof.

* * * * *